US008714411B2

(12) United States Patent
Gallaher et al.

(10) Patent No.: US 8,714,411 B2
(45) Date of Patent: May 6, 2014

(54) PORTABLE FLUID TREATMENT AND DISPENSING SYSTEM

(75) Inventors: Bruce Douglas Gallaher, Spokane Valley, WA (US); Pamela McCarty Gallaher, Spokane Valley, WA (US); George Arthur Gallaher, Spokane Valley, WA (US); Gail Hannah Gallaher, Spokane Valley, WA (US); Grant William Gallaher, Spokane Valley, WA (US)

(73) Assignee: Back Road Ventures, Inc., Spokane Valley, WA (US)

( * ) Notice: Subject to any disclaimer, the term of this patent is extended or adjusted under 35 U.S.C. 154(b) by 426 days.

(21) Appl. No.: 12/959,149

(22) Filed: Dec. 2, 2010

(65) Prior Publication Data

US 2012/0138705 A1 Jun. 7, 2012

(51) Int. Cl.
*B67D 7/80* (2010.01)

(52) U.S. Cl.
USPC ..... 222/146.6; 222/65; 222/189.06; 239/128; 239/444

(58) Field of Classification Search
USPC ..... 239/24–32, 128, 132–132.5, 444, 569, 239/579; 222/64–65, 189.06, 146.6
See application file for complete search history.

(56) References Cited

U.S. PATENT DOCUMENTS

| | | | | | |
|---|---|---|---|---|---|
| 1,038,399 | A | * | 9/1912 | Lindsay | 239/26 |
| 2,621,073 | A | | 10/1949 | Behrens | |
| 3,081,945 | A | | 3/1963 | Dickey | |
| 3,113,723 | A | | 12/1963 | Amt | |
| 3,142,443 | A | | 7/1964 | Morgan | |
| 3,351,286 | A | | 11/1967 | Abshire | |
| 4,193,518 | A | | 3/1980 | Holmes | |
| 4,526,125 | A | * | 7/1985 | Bain, Jr. | 114/347 |
| 4,869,402 | A | | 9/1989 | Ash, Jr. | |
| 5,094,388 | A | | 3/1992 | Chapman, Jr. | |
| 5,154,317 | A | | 10/1992 | Roppolo, III | |
| 5,199,609 | A | | 4/1993 | Ash, Jr. | |
| 5,238,559 | A | * | 8/1993 | Nieweg | 210/264 |
| 5,310,088 | A | * | 5/1994 | Burrows | 222/67 |
| 5,603,361 | A | | 2/1997 | Cuisinier | |
| 5,782,407 | A | | 7/1998 | VanDegrift | |
| 5,921,445 | A | | 7/1999 | Schmitz et al. | |
| 5,961,048 | A | | 10/1999 | Prieschl et al. | |
| 6,047,866 | A | | 4/2000 | Brown | |
| 6,047,898 | A | | 4/2000 | Cox | |
| 6,056,166 | A | | 5/2000 | Schmitz et al. | |
| 6,092,736 | A | | 7/2000 | Conkle | |
| 6,230,513 | B1 | | 5/2001 | Reinmuth | |
| 7,117,685 | B2 | | 10/2006 | Wetherbee | |
| 7,237,696 | B2 | | 7/2007 | Magermans et al. | |
| 7,635,069 | B2 | | 12/2009 | Spears | |
| 8,348,175 | B2 | * | 1/2013 | Kim | 239/14.1 |
| 2007/0187435 | A1 | | 8/2007 | Quirk | |

* cited by examiner

*Primary Examiner* — Christopher Kim
(74) *Attorney, Agent, or Firm* — Lee & Hayes, PLLC

(57) ABSTRACT

An apparatus and method for dispensing fluid to large numbers of people are disclosed. One embodiment of a portable apparatus for treating and dispensing fluid includes a housing that is fluidly attached to a fluid source. Several fluid delivery components are disposed within the housing to dispense fluid to a user. The fluid delivery components may include a pressure regulator, a backflow preventer, filters, cooling misters and dispensing valves such that the such that the fluid source integrity is protected, the fluid purity is improved, and the air within the housing is cooled which in turn provides cooling to the fluid delivery components and the fluid itself. This embodiment also includes a mechanism for providing ballast in the lower portion of the housing in order to stabilize the device and keep it from moving when bumped into by people (accidentally or intentionally) or in windy conditions, and a mechanism to empty the ballast for removal of the system.

8 Claims, 3 Drawing Sheets

PORTABLE FLUID TREATMENT AND DISPENSING SYSTEM

BACKGROUND

Maintaining an appropriate hydration level is critical for a human's health and vitality. Today, large numbers of people attend many different events, often in crowded and hot areas. It is easy for people to become dehydrated in these types of situations, and many different solutions have been used to help address this problem.

A typical solution is to license vendors to sell bottled water at these large events. This approach, however, is expensive, inefficient and wasteful. The consumer typically pays a high price for a small, prefilled bottle of water that provides adequate hydration for only a short time. Further, there is often no way to refill this bottle and, as such, the consumer must purchase another bottle. Because of the cost, people are hesitant to buy the amount of fluid needed to keep properly hydrated. Furthermore, the dispensing of the fluid is inefficient since people must stand in line and pay for the fluid each time. Vendors must guess, based on weather forecasts and predicted attendance, the appropriate quantity to have on hand. Finally, the waste, in the form of empty plastic bottles, can create environmental concerns.

Other approaches have also been used. In one approach, a platform with wheels is used. Several fountain bubblers or other water dispensers are attached to the top of the platform. Tubing is routed beneath the platform and attached to the water dispensers. A water source is then connected to the platform at a single point to supply all of the water dispensers with a water stream. This approach has several shortcomings: unpredictable taste, difficult dispensing and susceptibility to vandalism. For instance, the water quality can vary in different locations across the country and this system has no water treatment capabilities. Also, left unused in the heat of the day, the water can become very warm and, hence, unpleasant to drink. Additionally, since the water dispenser is attached to the top of the shallow platform, only certain size drinking containers can be easily filled. Finally, despite weighing about 70 lbs. and taking up significant square footage, the unit is so delicate that it must be placed in a secure storage area each evening.

Another approach is to install a semi-permanent structure that must be monitored while water is dispensed. While this system can, with enough time and manpower, be torn down, moved and rebuilt in another location, it is in no way portable. It is also difficult to locate large numbers of these devices in various places around an event, especially if the event spans a large area, to adequately provide enough fluid to hydrate the crowd. The manpower and expense of this type of solution does not lend itself to wide adoption.

Yet another approach is to have a large, customized trailer that is towed into place and hooked to the local water supply. Disposable cups are filled by authorized personnel. However, these trailers are expensive to construct and operate, have a large footprint which limits where they can operate, generate waste, and are also not very portable.

Based on the above, there remains a need for a low cost, portable, efficient method of dispensing fluid to a great number of people.

SUMMARY

An apparatus and method for dispensing fluid to large numbers of people are disclosed. One embodiment of a portable apparatus for treating and dispensing fluid includes a housing that is fluidly attached to a fluid source. Several fluid delivery components are disposed within the housing to dispense fluid to a user. The fluid delivery components may include a pressure regulator, a backflow preventer, filters, cooling misters and one or more dispensing valves such that the fluid source integrity is protected, the fluid purity is improved; and the air within the housing is cooled, which in turn provides cooling to the fluid delivery components and the fluid itself. This embodiment also includes a mechanism for providing ballast in the lower portion of the housing in order to stabilize the device and keep it from moving when bumped into by people (accidentally or intentionally) or in windy conditions, and a mechanism to empty the ballast for removal of the system.

An embodiment of a method for treating and dispensing fluid to a number of users is also described. The method may include connecting a pressurized fluid source to a supply line to direct a fluid stream, protecting the fluid source from backflow contamination, filtering the fluid stream within a portable fluid delivery system, cooling the system using a plurality of cooling misters, and dispensing the fluid stream simultaneously from a number of fluid outlets.

This Summary is provided to introduce a selection of concepts in a simplified form that are further described below in the Detailed Description. This Summary is not intended to identify key or essential features of the claimed subject matter, nor is it intended to be used as an aid in determining the scope of the claimed subject matter.

DETAILED DESCRIPTION

Today, fluid delivery systems that service large groups of people in locations that either do not have permanently installed fluid sources at all, or have minimal sources that do not currently lend themselves to dispensing to large numbers of people have not proven to be ideal to provide treated, cooled and easily available fluid. Embodiments of the present invention address these and other issues.

The portable fluid treatment and dispensing system described below provides users with a simple means of obtaining fluid to maintain appropriate hydration levels. The portable fluid treatment and dispensing system is also referred to as a fluid delivery system throughout this paper. In most instances, the fluid may comprise water; however, other ingestible fluids may be contemplated. Further the fluid is treated, cooled and provided to the user in locations in which such fluid was previously unavailable for ingestion by these users. The ease of use and expanded availability increases the chances of maintaining proper hydration, lowers the cost to the users and provides additional benefits for the environment.

Due to its portability and its lightweight construction, the fluid delivery system is easily carried to and from a remote dispensing location by a single person with no other human or mechanical assistance in some embodiments. The fluid delivery system is then connected to a fluid source and the system is filled to a predetermined level with fluid to act as a ballast to stabilize the system. The fluid delivery components within the housing treat and cool the fluid such that the fluid is ready to be dispensed from a number of dispensing valves protruding from the housing. The foregoing explanation provides a brief overview of the portable fluid delivery system; however, a more detailed description follows. An illustrative system is described, followed by a description of an illustrative process.

Illustrative System

Figure 1:
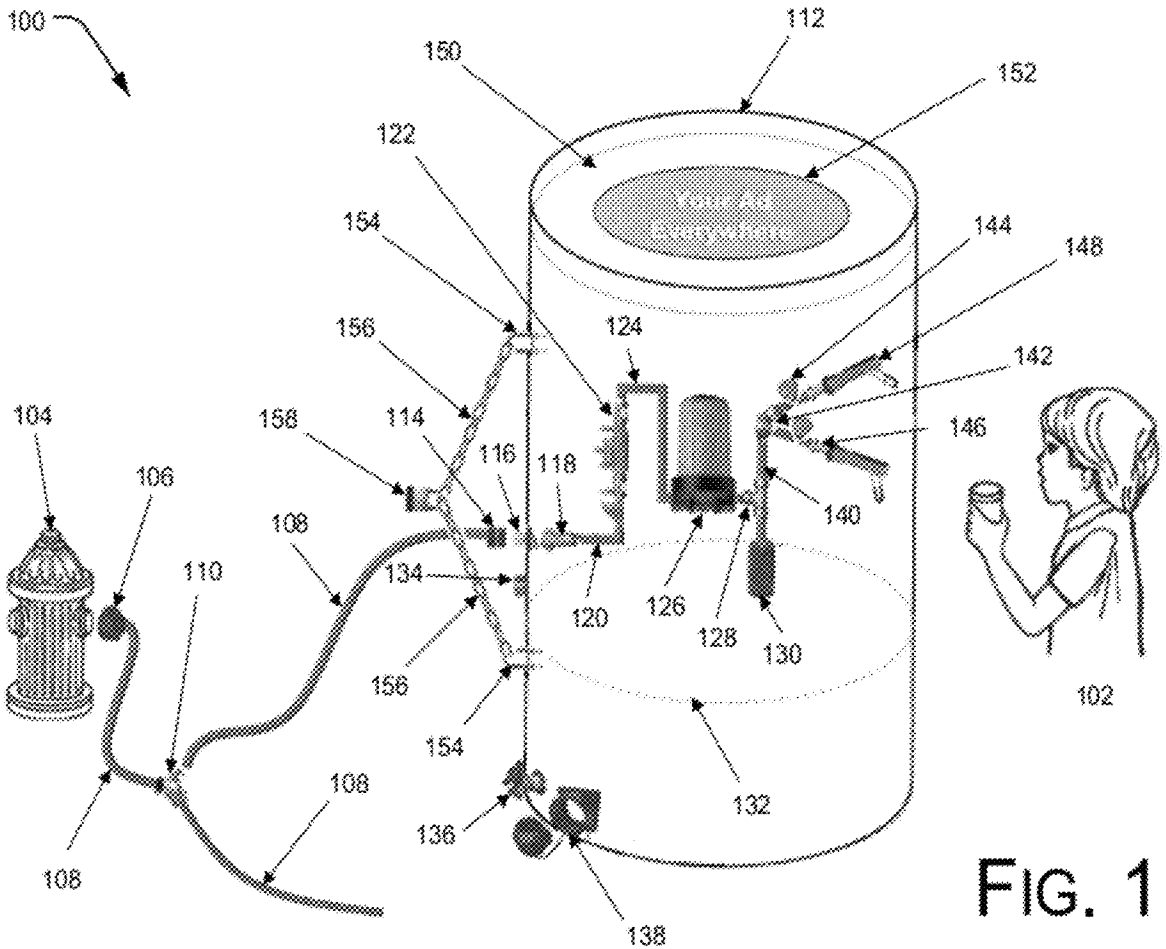
FIG. 1 is an illustration of a portable fluid delivery system.

FIG. 1 illustrates a fluid delivery system 100. In the system 100, a user or users 102 are able to fill any size or shape container, such as a container that can be held by user 102 to receive fluid from the fluid delivery system 100. To enable the user 102 to fill a container in this manner, the fluid delivery system 100 uses a pressurized fluid source 104. In FIG. 1, the pressurized fluid source 104 is shown as a fire hydrant; however, the pressurized fluid source 104 may be any type of fluid source such as a water fountain with external fittings, a water spigot or sillcock, an indoor faucet, a tanker truck, a water treatment trailer or similar type of fluid source. In some embodiments, it may be preferable to have a fluid source that does not become depleted or that is easily replenished. Further, the fluid source is sufficiently pressurized to allow the fluid to flow through the fluid delivery system 100 for dispensing to the user 102.

As illustrated in FIG. 1, a fitting 106 is connected to the pressurized fluid source 104. The fitting 106 may be an adapter that fits on a fire hydrant fitting or, if other types of pressurized fluid sources are used, it may be another type of fitting that connects to the fitting on a particular pressurized fluid source. The fitting 106 is generally an easily obtained fitting, such as a Style 37 2½" NH×¾" GHT Hydrant Adapter, manufactured by Red Head Brass of Shreve, Ohio in the case of the fluid source comprising a fire hydrant. The fitting 106 couples to a potable hose 108. The potable hose 108 is suitable for carrying fluid for drinking purposes. A potable hose, such as those used in recreational vehicle (RV) applications is suitable. Potable hose 108 couples, in turn, to a supply manifold 110. The supply manifold 110 may be used to supply multiple fluid delivery systems. In instances where a single fluid delivery system is used for a particular event, however, the system 100 may omit the supply manifold 110. However, in the case of larger events, two or more fluid delivery systems may be used and a manifold may be useful to optimize the available pressurized fluid sources. The supply manifold 110 may be a Y adaptor if only two fluid delivery systems are used or a different type of manifold may be used that has multiple connections if more than two fluid delivery systems are desired. Additionally, multiple Y adaptors may be used to connect more than two fluid delivery systems instead of a manifold with more than two connections.

FIG. 1 further illustrates that the potable hose 108 couples to a housing 112 through the use of a female fitting 114 and a male fitting 116. The housing 112 provides a protective structure to the fluid delivery components that reside within the housing 112. The housing 112 has a lid 150 to provide access to internal components for inspection, maintenance and repair. In some embodiments, the housing 112 is a food-grade barrel. Even though the fluid stream dispensed to the user 102 does not come into contact with the housing, most of the fluid delivery components and dispensing components (i.e., the components actually dispensing the fluid to the user 102) may reside within or may couple to the housing 112. As such it may be preferable in some instances to utilize food-grade materials.

The female fitting 114 attaches to the potable hose 108 as FIG. 1 illustrates. The male fitting 116, meanwhile, is secured through the wall of the housing 112. The male fitting 116 then couples within the female fitting 114 to form a generally leak-free connection to allow for a fluid stream to flow through the potable hose 108 and into the other fluid delivery components inside the housing 112. While a male/female fitting has been described, any fitting that allows for a pressurized fluid stream to flow leak-free through the connection may be used. The fitting 106, the supply manifold 110 and the potable hose 108 are located outside of the housing 112 and may be structurally reinforced to prevent accidental or intentional damage, and/or thermally insulated to prevent freezing or maintain a cooler temperature depending on the environmental conditions.

FIG. 1 also illustrates that a pressure regulator 118 couples to the portion of the male fitting 116 that extends internally into the housing 112. The pressure regulator 118 regulates the pressure of the fluid stream within a predetermined range. Typically, the desired pressure is similar to that of a U.S. household water pressure, such as around 40-70 psi, although other embodiments may employ any other pressure range. A main supply line 120 couples to the pressure regulator 118 at one end and a double check valve assembly 122 at the other end. The double check valve assembly 122 (or "backflow preventer") prevents the fluid from flowing backwards into main supply lines 120 and 108 and potentially contaminating the fluid source. The double check valve assembly 122 also may include a strainer to minimize contamination in the fluid and protect downstream system components. The fluid is filtered through the strainer to collect bits of materials, metals, etc. that may be a part of the fluid stream. The double check valve assembly may be a pre-fabricated assembly, such as part number 007QT-S manufactured by Watts® Water Technologies of North Andover, Mass. However, other similar backflow preventers may be used.

The fluid stream shown in FIG. 1 then flows through filter supply line 124 that couples at one end with the double check valve assembly 122 and at the other end to a filter 126. The filter 126 filters the fluid stream and removes contaminants in the fluid that may affect taste and/or smell. These contaminants may include chlorine, volatile organic compounds (VOCs) and other impurities. In another embodiment that is not shown, the backflow preventer and the filter may be placed in a separate enclosure located outside the housing 112. In this embodiment, the backflow preventer and the filter enclosure is located immediately after the pressurized fluid source 104 for the system. The rest of the system may remain the same except for the elimination of the double check valve assembly 122 and the filter 126 internally in the housing 112. Such an arrangement provides an opportunity for a much larger filter in the event such a large capacity filter is necessary. In either embodiment, any type of household filter may be used such as the Big Blue 10" filter, part number 150469 manufactured by Pentek® of Milwaukee, Wis. In addition, other types of filters may be contemplated such as multiple cartridge filters, sediment filters, and even reverse osmosis systems. The primary purpose of the filter is to provide high quality drinking water that tastes similar no matter the location or the output from the local water supply system.

As discussed above, the housing 112 shown in FIG. 1 and the fluid delivery components disposed within the housing 112 may be relatively lightweight to ensure portability and provide flexibility. For instance, the system 100 may be of a total weight that allows a single worker to carry the housing 112 and the components therein to a remote dispensing location without any other human or mechanical assistance. However, this lightweight design may cause the system to be unstable in some environments when empty (i.e., filled only with air). For instance, in some applications the system 100 may be positioned on uneven ground, may be subject to windy environments, or may be positioned at a large event such that it is likely that people may bump into the system (accidentally or intentionally). Each of these circumstances could cause the system 100 to become unstable and possibly fall over.

To counter this potential instability created by the lightweight design, the system may implement a ballast system to more firmly anchor the system to the ground when the system is positioned and coupled to a pressurized fluid source. For instance, the system 100 may include a ballast manifold 128, which fluidly connects to the output of the filter 126. The ballast manifold 128 directs the fluid stream in different directions. The first direction is toward a ballast float valve 130. The ballast float valve 130 allows the fluid stream to spill into the internal cavity of the housing 112 up to a certain level 132. By allowing fluid to fill the lower portion of the housing 112, 100 pounds or more of additional weight is added to the housing 112 to substantially lower the center of gravity and provide stability to the system. The ballast float valve 130 is positioned to allow the fluid stream to flow to a certain ballast level 132 at which point the ballast float valve 130 will rise with the fluid level and shut off the fluid stream to the internal cavity of the housing 112. If the ballast fluid level falls for any reason, the ballast float valve will descend, allowing fluid to again fill the cavity to the preset ballast fluid level. As the ballast fluid level rises, the float valve rises and shuts off fluid to the cavity once the preset ballast fluid level is reached.

Furthermore, in FIG. 1, in order to provide a backup mechanism for the ballast float valve 130 in the event of a malfunction, an overflow drain 134 may be incorporated in the housing wall. The overflow drain 134 is also valuable in normal operation. For example, the cooling misters 144 (described below) introduce additional fluid in the housing 112. In the event there is no seepage of fluid from the housing 112 or evaporation of fluid from the housing 112, the overflow drain 134 allows for weeping of an amount of fluid comparable to the amount added from the cooling misters 144 in order to maintain a preset ballast fluid level. The overflow drain 134 may be a hole cut in the housing wall that stays unplugged or it may use a drain line adapter that remains open. Further, there may be multiple overflow drains 134 located around the outside of the housing to prevent the housing 112 from filling with fluid in the event the ballast float valve 130 fails.

The fluid drain valve 136 (described below) or the overflow drain 134 (if the drain line adapter is in place) may be used to attach an additional hose to allow ballast fluid to be drained away from the system to prevent the weeping from occurring at the installation location. In addition, there may be a desire to run more fluid through the system such that more than just a weeping amount of fluid may be drained. For example, on a very hot day, for a long hose run exposed to the sun and/or sitting on a heat absorbing surface such as asphalt or concrete, it may be desirable to allow a small amount of fluid to flow through the system to help maintain the freshness and coolness of the fluid.

The FIG. 1 system 100 may also need to be removed from the remote dispensing location after an event is completed. Consequently, the ballast fluid may be purged prior to moving the housing 112. To do this purging, the system 100 includes a fluid drain valve 136 to purge the ballast fluid either prior to moving the housing 112 or as another manual backup protection in the event the ballast float valve 130 fails. Any type of fluid drain valve 136 may be used that provides for controlled, on/off removal of the fluid, such as a ¼ turn sillcock valve manufactured by Mueller® Water Products of Atlanta, Ga.

A purge outlet 138 may also be incorporated in the housing wall 112 in FIG. 1. The purge outlet 138 provides for quick removal of the ballast fluid by providing a larger, closable outlet in the housing wall. As such, the design of the system 100 provides a lightweight and portable solution that is nevertheless secure when in use.

As stated earlier, the fluid stream of FIG. 1 may leave the ballast manifold 128 in different directions. One direction is towards the ballast float valve 130 as previously described. The other direction is through a dispensing supply line 140. When the ballast float valve 130 is raised, fluid leaving the ballast manifold 128 travels in the direction of the dispensing supply line 140. The dispensing supply line 140 couples at one end to the ballast manifold 128 and at the other end to a dispensing line manifold 142. The dispensing line manifold 142 is designed to disperse the fluid flow in as many directions as necessary, depending on the number of dispensing outlets 148 desired.

As illustrated in FIG. 1, the fluid stream leaves the dispensing line manifold and proceeds through the dispensing valve supply line 146. A cooling mister or misters 144 are inserted into the dispensing valve supply line 146 such that the cooling mister 144 is sitting on top of and connected to the dispensing valve supply line 146. In this configuration, only a small portion of the fluid flows through the tiny openings in the cooling mister 144. The majority of the fluid continues to flow through the dispensing valve supply line 146. The cooling mister 144 may be an evaporative mist cooling device such as part number 10106 from Orbit® of Bountiful, Utah. The cooling mister 144 cools the air within the housing 112, which in turn cools the fluid delivery components located within the housing 112 to further provide for cooling the fluid stream. On a hot summer day, for instance, it is possible for the air temperature to reach 105 degrees Fahrenheit or more within the housing 112. In some embodiments the cooling mister 144 may have the capability to reduce the temperature as much as 25 to 30 degrees Fahrenheit within the housing 112.

A dispensing valve supply line 146 couples to the cooling mister 144 at one end and to a dispensing outlet 148 at the other end. The dispensing outlet 148 or container filler faucet may be a glass filler faucet manufactured by CHG® of Lakewood, N.J. Other types of dispensing outlets may be used that, manually and/or automatically, are easily turned on and off and which accommodate a variety of handheld containers that may be utilized by users. For example, in a manual operation, the dispensing outlets 148 may be activated by simply pushing a container against the dispensing outlets 148 and removing the container to stop the flow. In automatic operation, a self-closing push dispensing outlet 148 may be used. In this type of operation, the fluid stream is activated when a user operates a handle on the dispensing outlet 148 and the fluid dispenses for a predetermined period of time after the user releases the handle. In another type of automatic operation, the fluid stream is activated at the dispensing outlet 148 when a container is detected at the fluid outlet. This may be accomplished mechanically, optically, sonically or by another similar method. The fluid stream is deactivated when the container is no longer detected. The dispensing outlet 148 is secured by the wall of the housing 112 and extends internally from the dispensing valve supply line 146 through the housing wall 112 such that the dispensing portion of the dispensing outlet 148 protrudes externally from the housing for dispensing of the fluid by the user 102. In the case of multiple dispensing outlets 148, several users 102 may dispense fluid into their respective containers simultaneously. In some embodiments, the dispensing outlets 148 may be treated with an antimicrobial coating that prevents the growth of bacteria such as AgION™ from Agion Technologies of Wakefield, Mass.

The system 100 in FIG. 1 is designed such that the dispensing outlets 148 are located at a height at which people of all sizes 102 can access the outlet. Further, the dispensing outlets 148 are handicap accessible (e.g., a person in a wheelchair can pull up to the system and easily access a dispensing outlet 148) and ADA compliant (the self-closing push features ensure universal accessibility).

In some embodiments, the system 100 may also include security measures to secure the housing 112 and hinder tampering with the internal fluid delivery components of the system 100. In one embodiment, a lid 150 of the housing 112 may be locked to the housing 112 (not shown). The lid 150 may be locked using a stainless steel coupler latch model 1481DAT from Master Lock of Oak Creek, Wis. or any other suitable means. While this prevents the components located internally in the housing 112 from being tampered with, this solution does not secure the housing 112.

An additional security device to secure the housing 112 and prevent theft is shown in FIG. 1. One or more metal U-bolts 154 or security attachment points are secured to the housing wall using bolts or some other fastening mechanism such that the U-bolts 154 are secured internally within the housing 112 and extend through the housing wall. A metal torus link chain 156 may be permanently attached to the U-bolts 154. The chain 156 may be in two pieces such that it can be routed around an immovable, secured object to prevent theft. A padlock 158 may be used to lock the two free ends of the chain 156 around a secured object in order to secure the system 100. The immovable object may be a tree, a chain link fence or a concrete post with attachment points or any other immovable object that would secure the system 100. While a few examples of security devices have been discussed, other embodiments may utilize multiple additional or alternative security devices.

Finally, FIG. 1 illustrates that the system 100 may further serve as advertisement medium. For instance, an advertisement 152 may also be placed on the lid 150 to provide additional revenue or to advertise the event at which the fluid delivery system 100 is being utilized. In another embodiment (not shown), a raised portion may be attached to the lid 150 of the housing 112 such that the advertisement is displayed on the side of the raised portion for increased visibility. Advertisements may also be displayed on the housing 112 itself.

Figure 2:
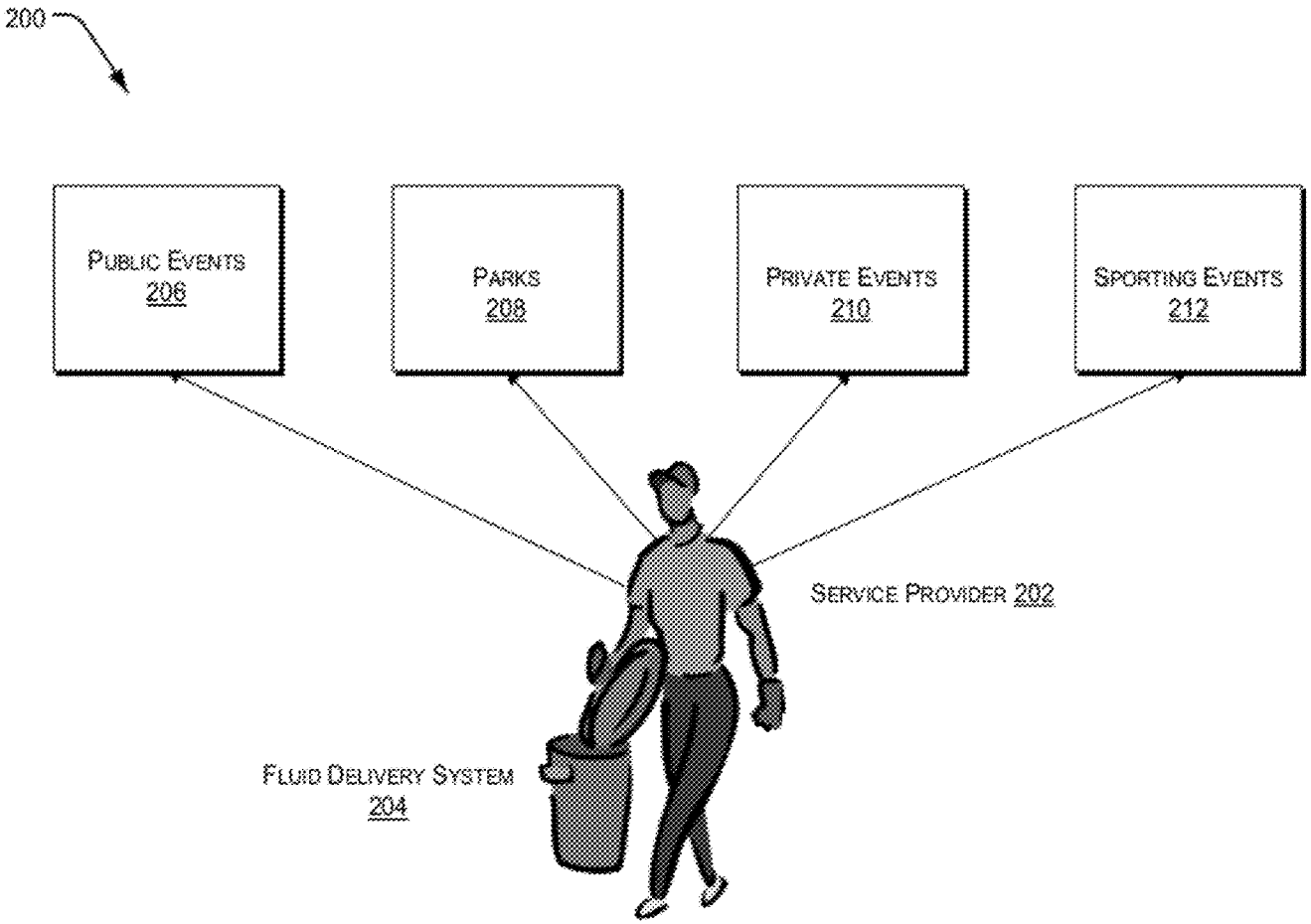
FIG. 2 is an illustration demonstrating the portability and the types of events in which the system may be used.

Referring now to FIG. 2, the portability of the fluid delivery system is illustrated. A service provider worker 202 may carry the system 204 by themselves without other human or mechanical assistance. The system 204 encompasses the housing 112 in FIG. 1 as well as all of the components disposed within the housing 112 and connected to the housing 112. The design of the fluid delivery system 204 is configured to weigh less than 30 pounds in some embodiments to allow this portability. The system can weigh as much as 50 pounds and still allow delivery by a single person without assistance depending on the person delivering the system. However, the 30 pound weight allows people of all sizes to deliver the system. Furthermore, the service provider 202 may carry the system 204 to a variety of remote dispensing locations such as public events 206, parks 208, private events 210 and sporting events 212. These events may include festivals, soccer games, weddings, parties, and construction jobs to name a few. Furthermore, the service provider 202 may temporarily install the system 204 at parks, schools and other locations for certain seasons (e.g., the entire summer or the fall football season) or for other extended periods of time.

Illustrative Process

Figure 3:
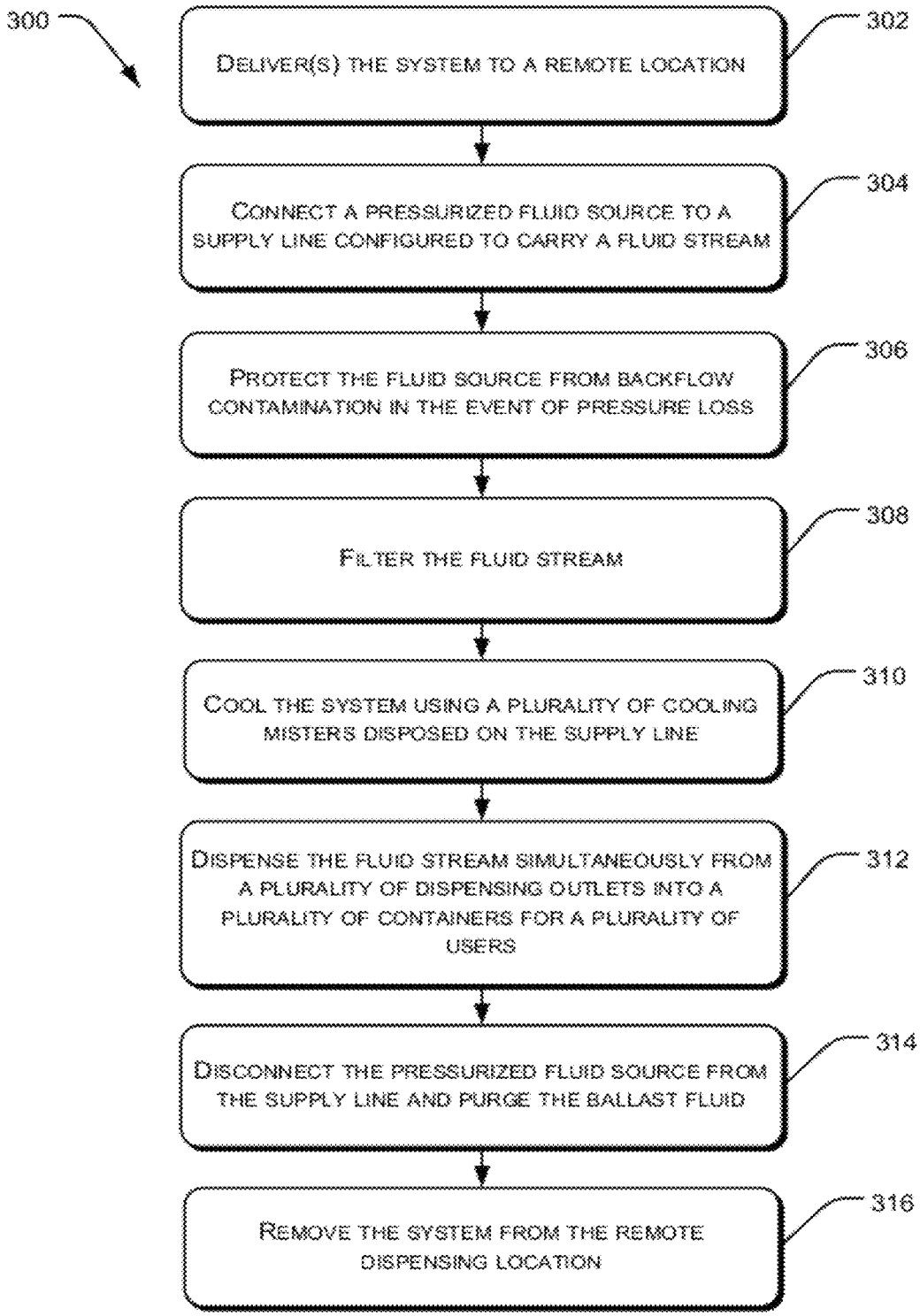
FIG. 3 is a flow diagram depicting an illustrative process in an example implementation for dispensing the fluid.

The following discussion describes a process for dispensing fluid depicted in FIG. 3. The process is shown as a set of blocks that specify operations performed. Note that the order in which the process is described is not intended to be construed as a limitation, and any number of the described acts can be combined in any order to implement the process, or an alternate process. Additionally, individual blocks may be deleted from the process without departing from the spirit and scope of the subject matter described herein. It should also be noted that the following example procedure may be implemented in a wide variety of environments without departing from the spirit and scope thereof.

FIG. 3 is a flow diagram depicting a procedure 300 in an example implementation in which one or more users are able to dispense fluid in a remote dispensing location. In operation 302, the system is delivered (e.g., carried, driven, etc.) by a service provider worker to a remote dispensing location as described above in FIG. 2. The remote dispensing locations may be locations such as locations 206, 208, 210 and 212 in FIG. 2. A supply line configured to carry fluid to a fluid stream is then coupled to a pressurized fluid or source in operation 304. The supply line includes the potable hose, the main supply line, the filter supply line and the dispensing supply line described above in FIG. 1.

In operation 306, the fluid source is protected from backflow contamination in the event of pressure loss. As described earlier in FIG. 1, a double check valve assembly or backflow preventer is used in one embodiment.

In operation 308 of FIG. 3, the fluid stream is filtered to remove contaminants that affect the taste and smell of the fluid to make it more pleasant to drink for the user(s) of the system. The system is cooled in operation 310 using a plurality of cooling misters disposed on the dispensing supply line. The misters cool the air within the housing, which in turn cools the fluid delivery components and the fluid stream. The fluid is dispensed in operation 312 simultaneously from a number of fluid dispensing outlets into a variety of containers that are brought by the users to be filled.

The pressurized fluid source is disconnected from the supply line and the ballast fluid is purged from the housing in operation 314 in order to minimize the weight of the system. The system is then removed from the remote dispensing location in operation 316.

CONCLUSION

Although the invention has been described in language specific to structural features and/or methodological acts, it is to be understood that the invention defined in the appended claims is not necessarily limited to the specific features or acts described. Rather, the specific features and acts are disclosed as example forms of implementing the claimed invention.

What is claimed is:

1. A portable drinking water delivery system comprising:

a housing;

a fitting at least partially disposed on an exterior of the housing for receiving an end of a pressurized fluid source;

a plurality of fluid delivery components disposed within the housing and defining a flow path for a stream of fluid through the housing, the plurality of fluid delivery components comprising:

a pressure regulator for regulating a pressure of the flow path;

a backflow preventer for preventing fluid from flowing backward through the flow path;

a filter for filtering the stream of fluid; and a cooling mister for cooling the stream of fluid by spraying a mist into the air within the housing surrounding the plurality of fluid delivery components;

a plurality of dispensing components attached to and protruding externally from the housing for dispensing the fluid from the flow path to a user after the fluid has been filtered and cooled by the plurality of fluid delivery components; and a ballast system comprising:

a ballast manifold fluidly connected to the stream of fluid and directing the stream of fluid from the plurality of fluid delivery components in a first direction to a ballast float valve and in a second direction to the plurality of dispensing components;

a cavity disposed in a bottom portion of the housing below the plurality of fluid delivery components to hold a stabilizing fluid that anchors the housing; and the ballast float valve movable between:

an open position directing fluid into the cavity when the stabilizing fluid is below a certain level, and a closed position preventing fluid from being directed into the cavity through the ballast float valve when the stabilizing fluid reaches or exceeds the certain level.

2. The portable drinking water delivery system of claim 1, further comprising a security component for attaching the portable fluid delivery system to a secure object.

3. The portable drinking water delivery system of claim 2, wherein the security component comprises:

an upper security attachment point located externally on the housing;

an upper security chain to attach to the upper security attachment point;

a lower security attachment point located externally on the housing;

a lower security chain configured to attach to the lower security attachment point; and a padlock to loop through a first link in the upper security chain and a second link in the lower security chain and secure the portable fluid delivery system.

4. The delivery system of claim 1, further comprising an overflow drain disposed in the housing to allow some of the stabilizing fluid in the cavity to escape when the stabilizing fluid in the cavity exceeds the certain level.

5. The delivery system of claim 1, wherein the cooling mister adds an additional fluid to the stabilizing fluid.

6. The delivery system of claim 1, wherein the stabilizing fluid comprises 100 pounds or more of weight.

7. The delivery system of claim 1, wherein the pressure regulator is configured to maintain a pressure of the stream of fluid between 40-70 psi.

8. The delivery system of claim 1, further comprising a purge outlet on the bottom portion of the housing.

* * * * *